US008201294B1

(12) United States Patent
Lee

(10) Patent No.: US 8,201,294 B1
(45) Date of Patent: Jun. 19, 2012

(54) TRIPLE HELIX HORIZONTAL SPANNING STRUCTURE

(76) Inventor: Haewon Lee, New York, NY (US)

( * ) Notice: Subject to any disclaimer, the term of this patent is extended or adjusted under 35 U.S.C. 154(b) by 88 days.

(21) Appl. No.: 12/695,430

(22) Filed: Jan. 28, 2010

(51) Int. Cl.
*E01D 19/00* (2006.01)

(52) U.S. Cl. ..... 14/13; 14/78

(58) Field of Classification Search ..... 14/13, 18, 14/19, 78; 52/694.4, 651.11, 108, 646, DIG. 10; 244/159.4, 159.5, 172.6
See application file for complete search history.

(56) References Cited

U.S. PATENT DOCUMENTS

| | | | | | |
|---|---|---|---|---|---|
| 108,663 | A | * | 10/1870 | White | 14/3 |
| 379,217 | A | * | 3/1888 | Green | 52/651.11 |
| 1,617,262 | A | | 2/1927 | Malone | |
| 1,764,494 | A | * | 6/1930 | Bauer | 52/649.3 |
| 1,793,928 | A | | 2/1931 | Hammel | |
| 3,445,905 | A | | 5/1969 | Spencer | |
| 3,495,286 | A | * | 2/1970 | Harper | 14/78 |
| 3,798,864 | A | | 3/1974 | Georgii | |
| 4,454,620 | A | * | 6/1984 | Barkdull, Jr. | 14/20 |
| 4,532,742 | A | * | 8/1985 | Miura | 52/108 |
| 4,662,130 | A | * | 5/1987 | Miura et al. | 52/108 |
| 4,704,754 | A | | 11/1987 | Bonasso | |
| 4,901,483 | A | | 2/1990 | Huegy | |
| 5,097,646 | A | | 3/1992 | Lamle | |
| 5,522,569 | A | * | 6/1996 | Steffy et al. | 244/158.1 |
| 5,921,048 | A | | 7/1999 | Francom et al. | |
| 5,977,932 | A | * | 11/1999 | Robinson | 343/895 |
| 6,345,482 | B1 | * | 2/2002 | Warren | 52/646 |

FOREIGN PATENT DOCUMENTS

| | | |
|---|---|---|
| EP | 0666612 | 8/1995 |
| GB | 2.107.765 | 5/1983 |
| WO | WO91/15621 | 10/1991 |

* cited by examiner

*Primary Examiner* — Robert Pezzuto
*Assistant Examiner* — Matthew D Troutman
(74) *Attorney, Agent, or Firm* — Michael I. Kroll

(57) ABSTRACT

A triple-helix horizontal spanning structure comprised of three helical beams in compression and cables in tension which integrate with the helical compression members and together form a structure that is stable. Anchored at each end, the structure is a single-span structure without any intermediate vertical members such as columns or pylons. This super structure provides a longitudinal space for the sub structure to be hung within the helical beams and cables that can serve as platform for such things as roads or passageways.

4 Claims, 8 Drawing Sheets

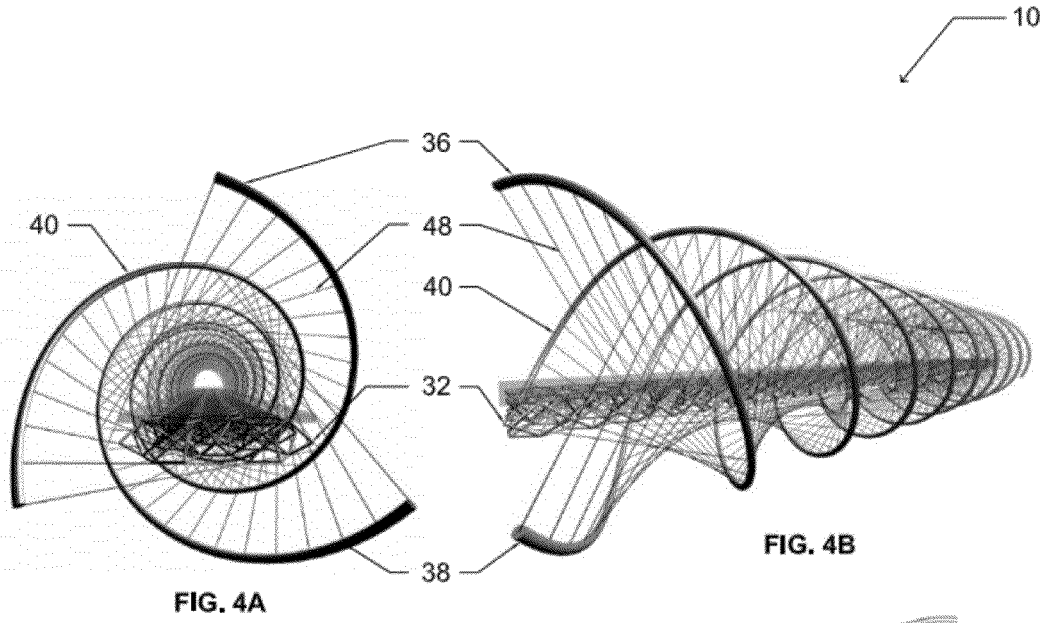
FIG. 4A
FIG. 4B
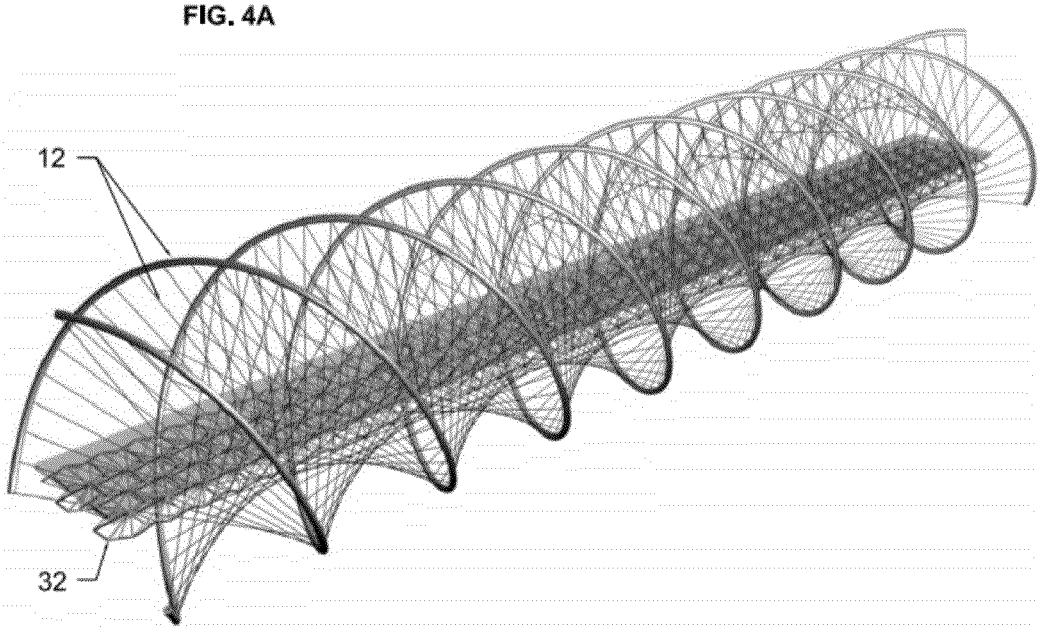
FIG. 4C

TRIPLE HELIX HORIZONTAL SPANNING STRUCTURE

BACKGROUND OF THE INVENTION

1. Field of the Invention

The present invention relates generally to spanning structures and, more specifically, to a triple-helix horizontal spanning structure comprised of three helical beams in compression and cables in tension which integrate with the helical compression members and together form a structure that is stable.

Anchored at each end, the structure is a single-span structure without any intermediate vertical members such as columns or pylons. This super structure provides a longitudinal space within the helical beams that can serve as platform for such things as roads or passageways.

The structure for a road or deck is a sub structure that is hung and held by the super structure, comprised of a kind of space frame system with a configuration of its web members, also not yet known or discovered in the prior art.

Historically, structures in tension have proven to span longer distance and with greater strength than conventional post and beam structures. The triple-helix horizontal spanning structure system of the present invention is distinctively different and does not operate as other structures known to operate in tension, such as tensile or tensegrity structures.

This application for triple-helix horizontal spanning structure provides an illustration of one embodiment of the present invention for illustrative purposes and should not be construed as the only possible application of the present invention.

Herein described and illustrated is a "Triple-Helix Horizontal Spanning Structure", whose classification and terminology for this type of structure has not been defined in academics and in architecture, engineering and the construction industry.

The "Triple-Helix Horizontal Spanning Structure" will innovate multiple industries when it is built. Since it does not require intermediate columns or pylons that go deep down into river beds, it will reduce cost of materials required when used in bridge construction. It will require a higher degree of custom precision in design and engineering for construction due to its complexity, such as cable connections or fabrication of segments of helical beams, however, due to its repetitive and modular uniformity of the structure and form, those elements can be massed produced once one is defined.

The "Triple-Helix Horizontal Spanning Structure" will challenge the way infrastructure is considered as well as architecture, engineering and construction methods known today.

2. Description of the Prior Art

There are other helical devices designed as support structures. Typical of these is U.S. Pat. No. 1,617,262 issued to Malone on Aug. 19, 1926.

Another patent was issued to Hammel on Feb. 24, 1931 as U.S. Pat. No. 1,793,928. Yet another U.S. Pat. No. 3,445,905 was issued to Spencer on May 27, 1969 and still yet another was issued on Mar. 26, 1974 to Georgii as U.S. Pat. No. 3,798,864.

Another patent was issued to Bonasso on Nov. 10, 1987 as U.S. Pat. No. 4,704,754. Yet another U.S. Pat. No. 4,901,483 was issued to Huegy on Feb. 20, 1990. Another was issued to Lamle on Mar. 24, 1992 as U.S. Pat. No. 5,097,646 and still yet another was issued on Jul. 13, 1999 to Francom et al. as U.S. Pat. No. 5,921,048.

Another patent was issued to Cooper on May 5, 1983 as U.K. Patent No. GB2107765. Yet another International Patent Publication No. WO 91/15621 was published to Hess on Oct. 17, 1991. Another was published to Robinson on Aug. 9, 1995 as European Patent Application No. EP0666612.

U.S. Pat. No. 1,617,262

Inventor: Adolph W. Malone

Issued: Feb. 8, 1927

A post of the class described formed of two groups of continuous bars of angle iron, one group wound right-band and the other group wound left-hand, the faces of the several bars of each group being set, parallel with the corresponding faces of the other group and the bars of the two groups being secured together at crossing points, substantially as set forth.

U.S. Pat. No. 1,793,928

Inventor: Victor F. Hammel

Issued: Feb. 24, 1931

A latticed metal pole or column comprising rods wound in left and right hand helices together with stiffened bars extending longitudinally in contact with said rods and welded thereto at the contact points.

U.S. Pat. No. 3,445,905

Inventor: John A. Spencer

Issued: May 27, 1969

In a cylinder roll for papermaking machines, a cylindrical supporting structure for a wire mesh covering comprising, a plurality of longitudinally-spaced coaxial circular head members, a plurality of circumferentially arranged supporting members extending between said head members and arranged parallel to the axis of said head members and connected thereto, a spirally-wound thin-gauge winding wire of rectangular cross-section having longitudinally-spaced outwardly projecting notches, and a wire mesh covering outwardly spaced from said supporting members and supported by said winding wire.

U.S. Pat. No. 3,798,864

Inventor: Hans Christer Georgii

Issued: Mar. 26, 1974

A supporting structure comprises longitudinal rods and transverse straight rods interconnecting the longitudinal rods. The transverse straight rods are constituted by two systems of helically wound wires, and each of the systems comprises at least two wires of the same cross sectional shape. The wires of one system are wound in one direction while the wires of the other system are wound in the opposite direction. The resulting helically wound wires are united with the longitudinal rods at the crossings between the rods and the wires.

U.S. Pat. No. 4,704,754

Inventor: Samuel G. Bonasso

Issued: Nov. 10, 1987

A structural system for use in bridges, buildings and other structures. The system supports part of its load by tension action and part of its load by arch action. Cables are stretched and anchored between end supports. Lateral compressive elements are placed over the cables and fit over grooves across the bottoms of the elements. The grooves vary in depth. The cables are near the bottom of the elements at the center span and near the top of the elements at the end supports.

U.S. Pat. No. 4,901,483

Inventor: Charles W. Huegy

Issued: Feb. 20, 1990

A building of geodesic dome type based on a variant of the helix formula and exhibiting the engineering characteristic known as tensegrity. All juncture points are precisely located from the jig for construction. A method of top closure enabling easy construction is included.

U.S. Pat. No. 5,097,646

Inventor: Stewart Lamle

Issued: Mar. 24, 1992

A compound building member for use in fabricating structures. The member in a first form includes a plurality of elements having a rotationally asymmetric closed plane cross section, the rotational asymmetric elements are helically wound in complementary fashion and intertwined to form a cylindrical lattice body that extends in the members longitudinal direction. In addition, the rotationally asymmetrical elements are twisted about their longitudinal axis to form peaks and valleys in the elements. Further, the elements are aligned when intertwined such that the twist valleys are located at element cross points and the twist peaks located between successive element cross points so that the elements nest with one another at the cross points. Additionally, the slope between the twist valley and peak form shoulders that restrain movement of the member elements. In one of several other forms of the invention, linear, elements are located at the members perimeter extending in the longitudinal direction of the cylindrical body of the first form in contact with the element cross points to further support the member. In yet another form, annular, radially extending elements are added to the first form to contact the element cross points at locations along the cylindrical body's length to provide added support to the member. In still another form, the linear element and the radial elements are added to the first form of the member. Finally, in yet another form, any of the various forms of the member is encased in a matrix of concrete or a polymeric material.

U.S. Pat. No. 5,921,048

Inventor: Larry R. Francom et al.

Issued: Jul. 13, 1999

A structural member having greatly enhanced load bearing capacity per unit weight has a plurality of helical components wrapped around a longitudinal axis. The helical components have straight segments rigidly connected end to end in a helical configuration. In a basic repeating unit, three helical components have a common angular orientation, a common longitudinal axis, and are spaced apart from each other at equal distances. Another three reverse helical components also have a common angular orientation, a common longitudinal axis, and are spaced apart from each other at equal distances, but have an opposing angular orientation. These six helical components appear as a triangle when viewed along the axis due to the straight segments. An additional six helical are configured as above but rotated with respect to the first six components such that the member appears as a six-pointed star when viewed from the axis.

U.K. Patent Number GB2107765

Inventor: Leslie Trevor Cooper

Published: May 5, 1983

A lining (1) for a tunnel has a wall structure comprising a reinforced plastics inner layer (2) and a ribbed, reinforced plastics outer layer (3) incorporating particulate material (25), e.g. sand. Preferably the tunnel lining (1) is tubular and the outer layer (3) comprises a lattice-like structure made up of at least two courses of helical ribs (4, 5). The ribs (4) of one course have a different hand to the ribs (5) of the or each adjacent course so that the ribs (4, 5) of adjacent courses cross one another to define a plurality of diamond-shaped recesses (6).

International Patent Application Publication No. WO91/15621

Inventor: Joseph P. Hess

Published: Oct. 17, 1991

An antenna structure in which the antenna is in the form of a helical foil (12) which is supported by winding it on a hollow cylindrical braid (10), the foil (12) and the braid cylinder (10) being potted in a resin. An integral mounting flange (16) is provided at one end. The structure is made by providing a cylindrical mandrel (20) with a flange at one end, braiding a sleeve (10) of fiberglass, for example, over the exterior of the mandrel, winding a foil of conductor (12) such as copper foil around the braided mandrel in the form of an antenna, potting the assembly in an appropriate resin, and then removing the mandrel. The mounting flange (16) is preferably built up in thickness and strength by placing a plurality of thin annular, centrally-operated discs (40) over the cylinder and against the flange, prior to potting.

European Patent Application Publication No. EP0666612

Inventor: Anthony D. Robinson

Published: Aug. 9, 1995

A helical antenna structure is deformable and capable of being stowed in a small volume. At deployment, the helical antenna structure uses the stored strain energy in its resilient helices to revert to its original shape without the use of any outside force. Multiple antenna structures can be linked using a plurality of resilient lenticular shaped hinges.

While these structures may be suitable for the purposes for which they were designed, they would not be as suitable for the purposes of the present invention, as hereinafter described.

SUMMARY OF THE PRESENT INVENTION

The present invention provides a triple helix super structure to span between distal anchored ends and a sub structure to span between the helical beams.

The fundamental geometry that platforms the super structure is a hexagon. Each module of rotation of helical beams can be simplified as a linear hexagon, subdivided into six segments, stretched from start point of rotation to the end point where it completes rotation at 360 degrees. When these three six-segmented and stretched hexagon are juxtaposed into position based on equilateral triangle from each ends, a trajectory is formed that follows triple helical form, simplified as linear members.

The linear segments provide primary points where the cables as tension members can be connected to, from one hexagon to adjacent second hexagon and to the third.

Each single point of the stretched hexagon bears two tension members, which within themselves form near 90 degrees prior to being pulled. The primary trajectory of the cables begins from first starting point of a stretched hexagon then is connected to the alternating hexagon, specifically to the third point from the starting point.

This trajectory forms a diagonal in three dimensions, not linear or parallel to overall configuration of geometry. When this process is repeated for all points of three stretched hexagon, other geometry appears and can be seen when looking through from the side; a six-pointed star.

Since horizontal-spanning structure in infrastructure scale can be comprised of long distances, intermediate connecting members are required in between the hexagonal points.

When these diagonal tension members are rotated with equal subdivisions as required within the hexagon, the linear compression members of hexagon forms an outward curve, opposite of inward curve formed by pulling forces of the tension members, to resist bending. These outward curves form uniform helixes. In section, they form a perfect circle.

The diagonal trajectories for cables do not intersect with each other and are in opposite direction to rotation of hexagons. The rotating tension members with equal subdivisions create an empty space within the super structure, also forming a perfect circle of space in section, thus creating 25% occupiable space within three helixes.

This super structure operates on pulling forces at large from each end of the structure and must be anchored with capacity of forces that stabilizes its pulling forces, in proportion to its span that the anchor holds.

In principle, similar analogy can be described with a spring pulled and anchored from each end or a Chinese Handcuff, when pulled from each end it becomes rigid and one cannot take their fingers out. For the anchors, the resultant vector of the present invention's tension forces and gravity is currently under consideration; in other words, leverage between mass of the anchor and the theta angle of the resultant vector is currently under investigation to create the most optimal anchor system for the present invention.

The fundamental geometry that platforms the sub structure is a hexagon. The unit or module of the space frame (Thus hereto called "Hexagonal Space Frame" is comprised of two hexagons spaced vertically in proportion.

The web members connect from first point at the bottom hexagon to third point of upper hexagon from where it is vertically projected. The other web members repeat its order of configuration in the same direction of rotation of the web members. When this is completed for all points of the two hexagons, a module of "Hexagonal Space Frame" is formed. The module is not autonomous and cannot work by itself. However, when the module is surrounded by other modules in hexagonal directions, a pyramid of webs are formed from top and bottom by the webs supporting hexagons above and below.

In structural engineering, it is proven and known that three points are required to make a structure stable. In "Hexagonal Space Frame", the configuration of the web forming pyramid from top and bottom appears at every six points of the hexagon as each module is placed next to one another; that which 3-dimensional top and bottom triangulation makes the structure even more stable than 2-dimensional stabilizing triangulation.

The system is continuous, meaning its modules can continue to grow. However, when it is in a condition where it needs to end, sub system is required to close the system in order to be integrated to connecting points or condition at the end. Structural systems, such as spider web connections are appropriate, to connect multiple edge points of hexagons and merging those points into one single connection. The sub system of the space frame—to close its continuity, is currently under investigation and development.

This space frame spans in between the helixes, connected and secured to the super structure from top, side and bottom. Not only it is known in the architecture and engineering industry that space frame system has the capacity to span long distances, but also because of its modularity, capabilities for pre-fabrication and mass production is also considered a merit in utilizing such system. The configuration of three-dimensional and web also creates other geometry, a six pointed star, when looking from the top in plan view.

A primary object of the present invention is to provide a horizontal spanning structure comprised of a triple helix.

Another object of the present invention is to provide a horizontal triple helix structure incorporating a planar structure passing therethrough.

Another object of the present invention is incorporating a planar structure through "Hexagonal Space Frame" of which the webbing configuration is not yet known or discovered.

Yet another object of the present invention is to provide a triple helix horizontal structure wherein said helical members are in compression by means of cables of specific configurations in tension, binding helixes to one another to strengthen the three.

Still yet another object of the present invention is to provide a triple helix horizontal structure wherein said planar surface is a roadway for people, motorized vehicles and mass transit.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 4A is an illustrative interior view of the Triple Helix Horizontal Spanning Structure.

FIG. 4B is an illustrative perspective view of the Triple Helix Horizontal Spanning Structure.

FIG. 4C is an illustrative isometric view of the Triple Helix Horizontal Spanning Structure.

DESCRIPTION OF THE REFERENCED NUMERALS

Figure 1A:
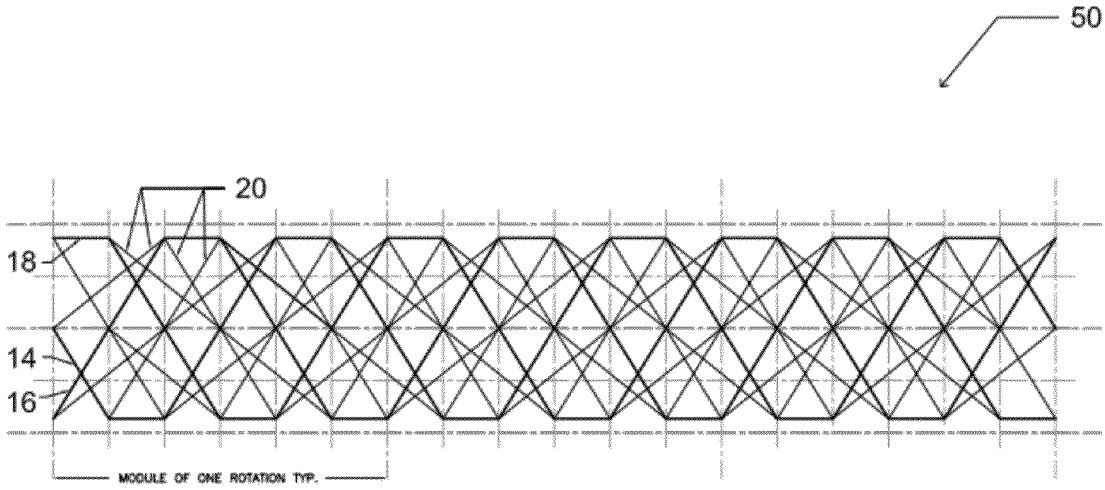
FIG. 1A is an operating geometry in plan (stretched hexagon per rotation).

Turning now descriptively to the drawings, in which similar reference characters denote similar elements throughout the several views, the figures illustrate the Triple Helix Horizontal Spanning Structure of the present invention. With regard to the reference numerals used, the following numbering is used throughout the various drawing figures.

10 Triple Helix Horizontal Spanning Structure
12 super structure
14 hexagon 1
16 hexagon 2
18 hexagon 3
20 primary cable trajectories
22 first hexagon start point
24 second hexagon start point
26 third hexagon start point
28 helix path
30 occupiable space
32 sub structure
34 anchor option
36 helix 1
38 helix 2
40 helix 3
42 crossing datum line
44 line of subdivision
46 Hexagonal Space Frame module
48 cables
50 operating geometry
52 Hexagonal Space Frame

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Figure 1B:
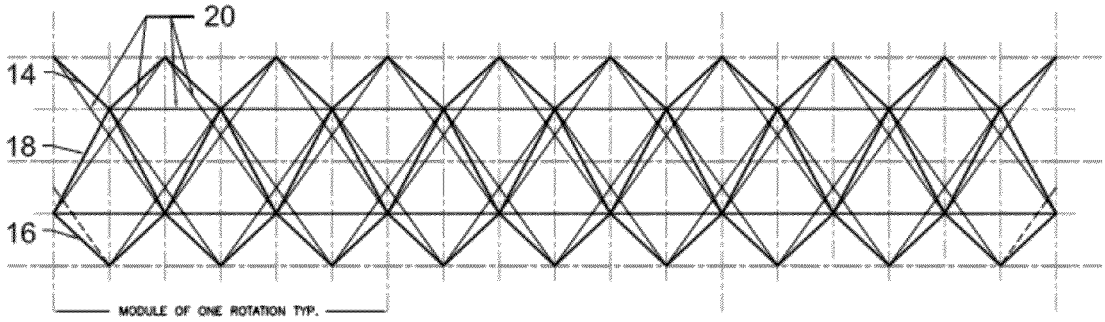
FIG. 1B is an operating geometry in elevation (stretched hexagon per rotation).
Figure 1C:
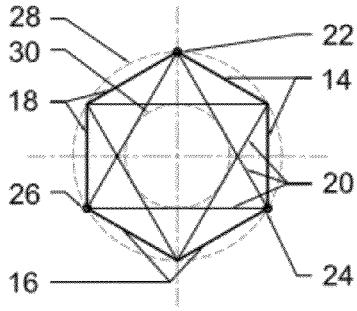
FIG. 1C is an operating geometry in section (stretched hexagon per rotation).

Referring to FIGS. 1A-1C, shown are illustrative views of operating geometry 50 of the present invention 10. Shown is the operating geometry 50 of the present invention 10 comprising a first hexagon 14, a second hexagon 16, a third hexagon 18 and primary cable trajectories 20 in opposite direction to the hexagonal rotation to form binding super structure 12 of triple helix in compression and cables in tension. Also shown are the first hexagon start point 22, the second hexagon start point 24, the third hexagon start point 26 the helix path 28 and 25% occupiable space 30.

Figure 2A:
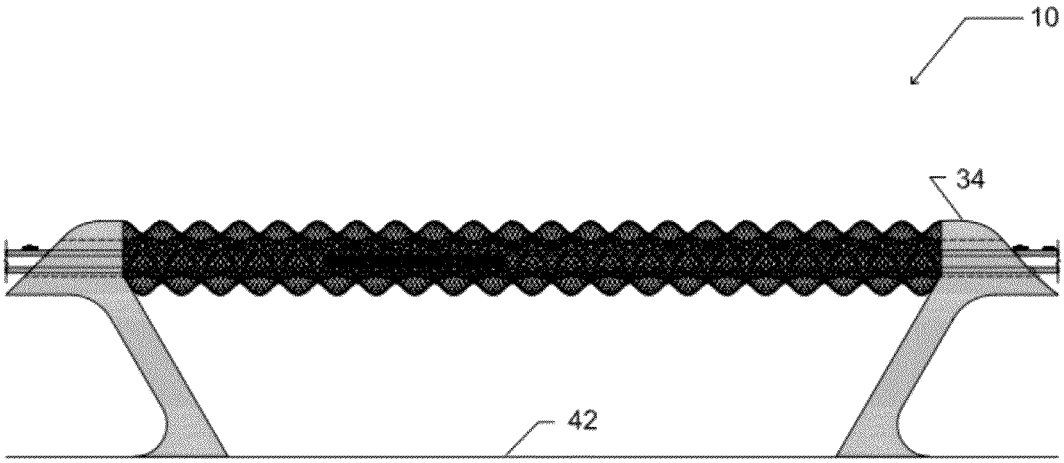
FIG. 2A is a side elevation of the Triple Helix Horizontal Spanning Structure for a bridge application.
Figure 2B:
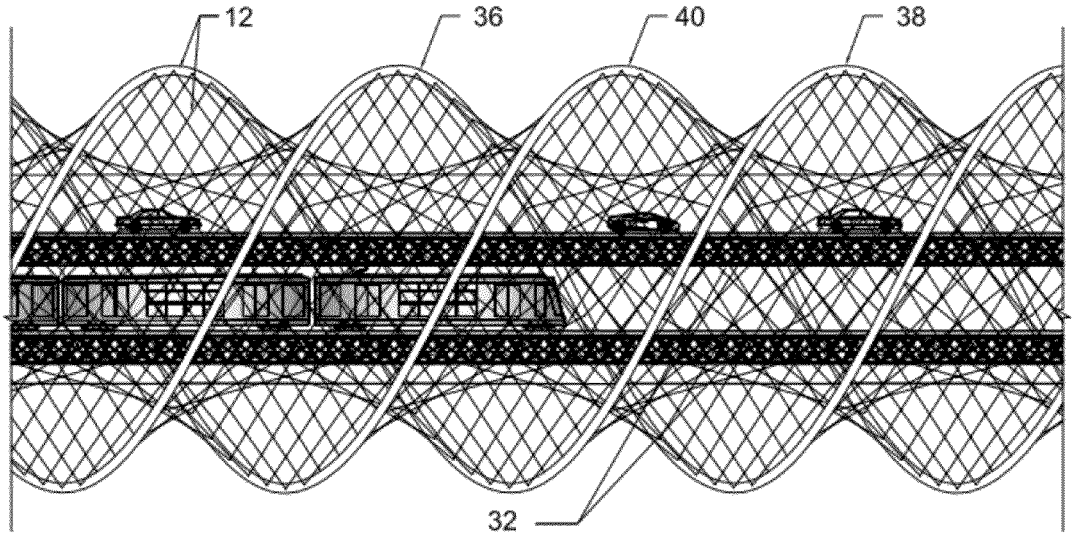
FIG. 2B is a side elevation close-up view of the Triple Helix Horizontal Spanning Structure for a bridge application.

Referring to FIGS. 2A-2B, shown are illustrative side views of the triple helix super structure 12 and sub structure 32 of the present invention 10 in use. Shown is the present invention comprising a bridge having a super structure constructed primarily of triple helix and cables binding said first helix 36, said second helix 38 and said third helix 40 to one another to strengthen the three while providing and supporting sub structure of planar deck for the transportation of vehicles, mass transit and people. Also shown are an anchor option 34 and the crossing datum line 42.

Figure 3:
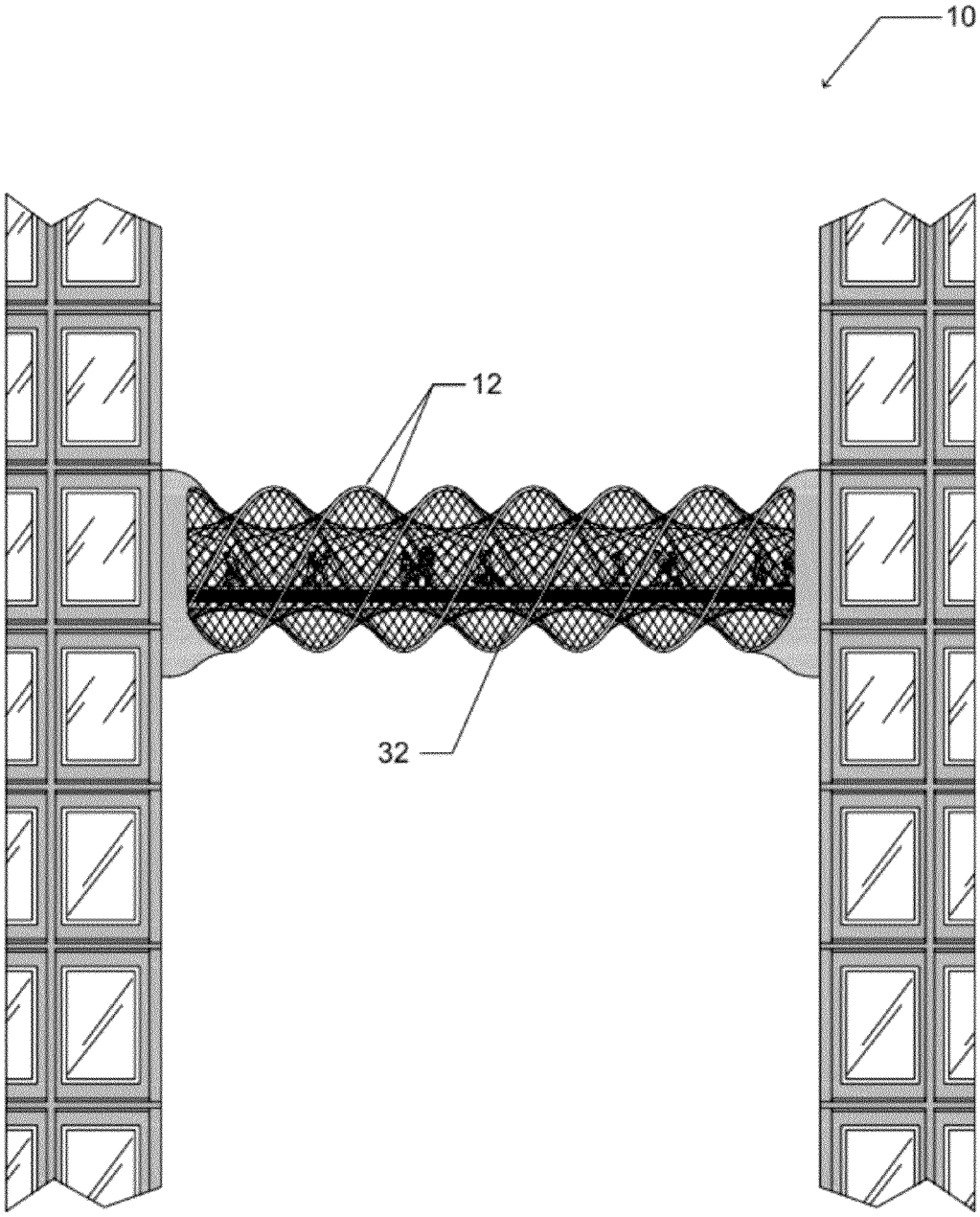
FIG. 3 is a side elevation of the Triple Helix Horizontal Spanning Structure for a sky bridge application.

Referring to FIG. 3, shown is a side elevation of the triple helix horizontal spanning structure for a sky bridge application in use. Shown is the present invention 10 in use as an elevated walkway comprising a super structure 12 of triple helix and cables binding said helixes to one another to strengthen the three while providing and supporting in said sub structure 32 a planar deck for the movement of people.

Referring to FIGS. 4A-4C, Shown are interior, perspective and isometric views of the present invention 10. Shown is the present invention being a super structure 12 comprised primarily of triple helix 36 38 40 and cables 48 binding said helixes to one another to strengthen the three while providing in said sub structure 32 a planar deck for the transportation of vehicles, mass transit and people.

Figure 5:
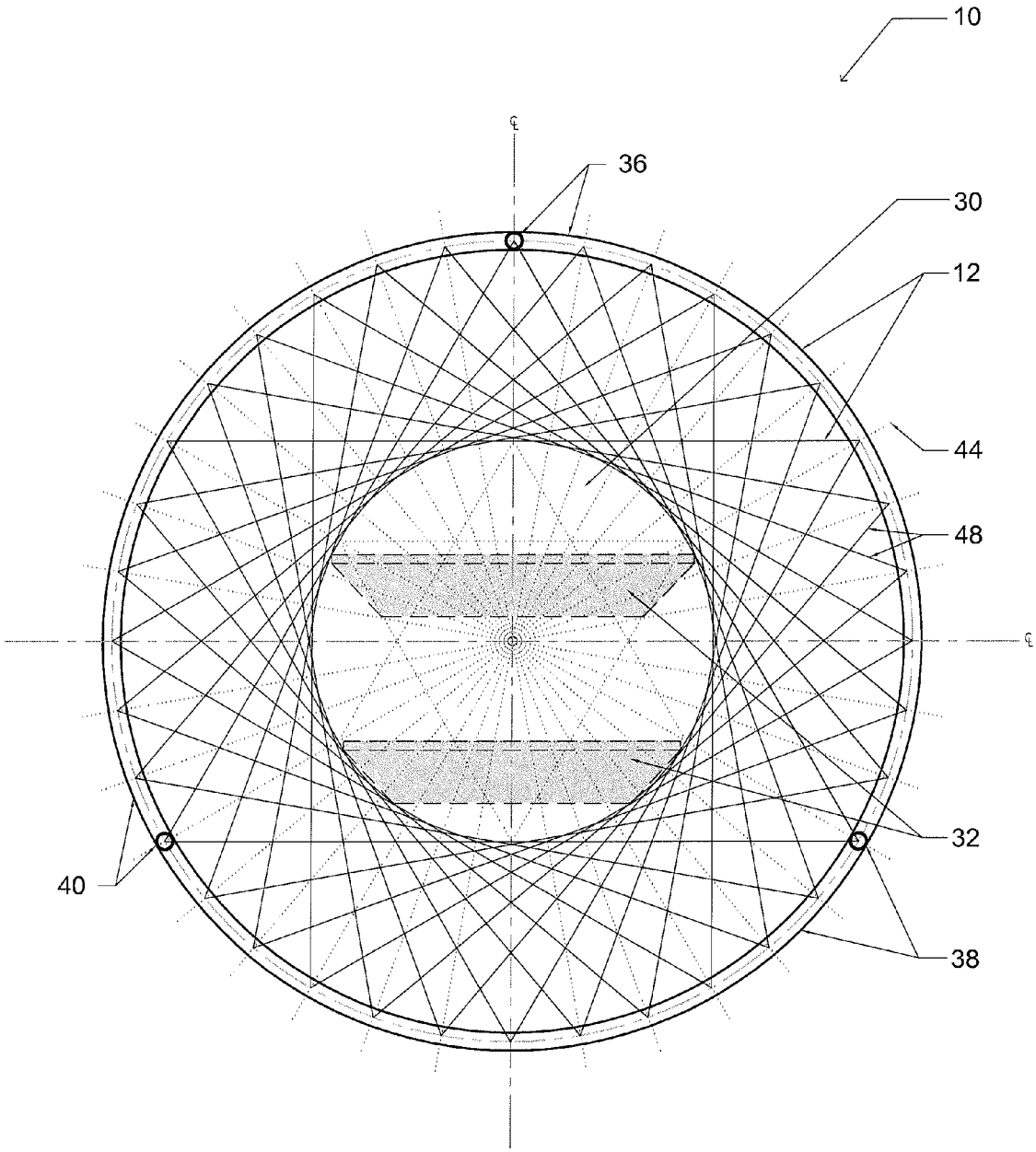
FIG. 5 is a sectional view of the Triple Helix Horizontal Spanning Structure.

Referring to FIG. 5, shown is a sectional view of the present invention 10. Shown is the present invention comprising a super structure 12 formed from triple helix 36 38 40 and cables 48 binding said helixes to one another to strengthen the three while providing in said sub structure 32 a planar deck for the transportation there through of vehicles while providing 25% occupiable space 30. Also shown is the line of subdivision 44 (as required).

Figure 6:
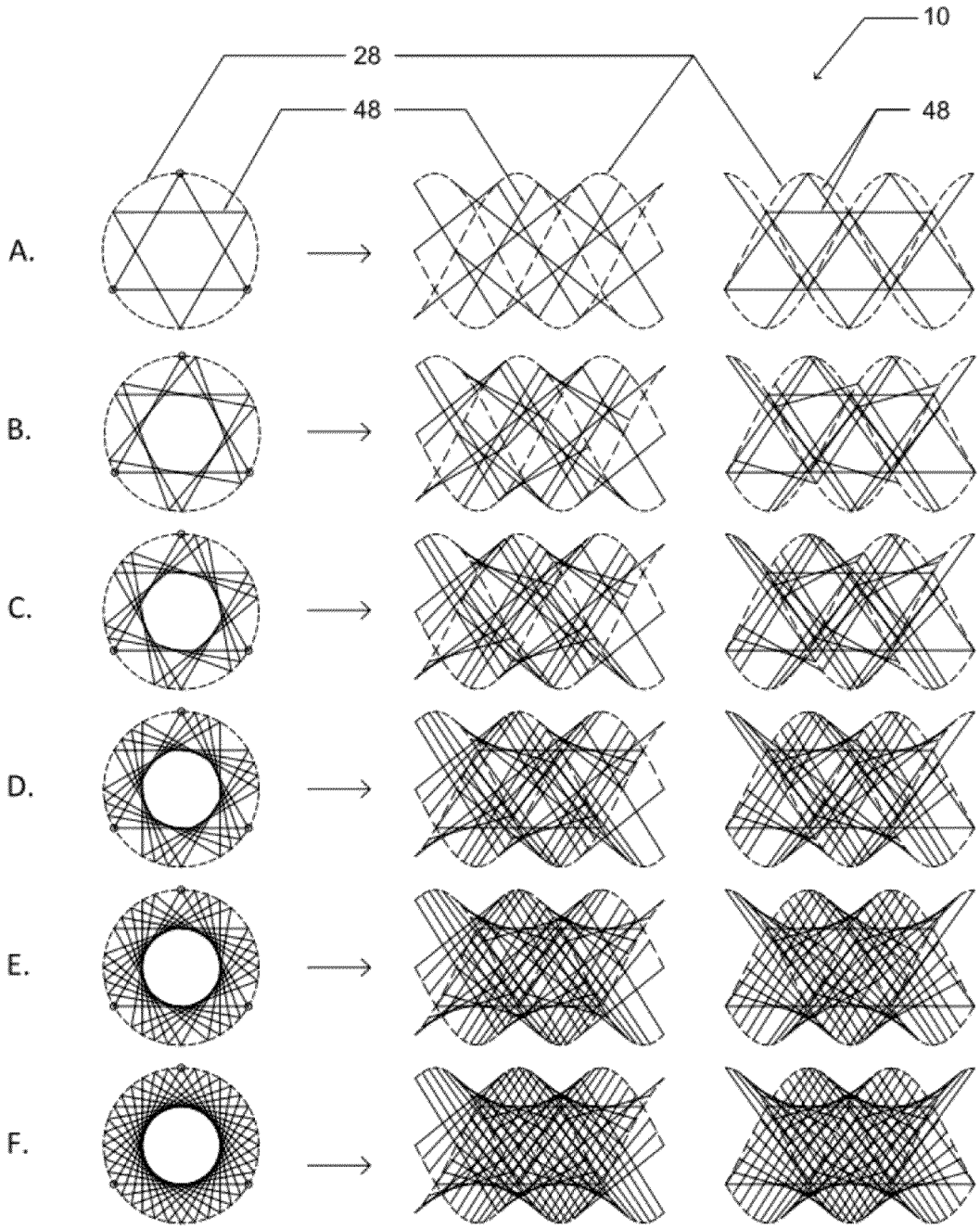
FIG. 6 is section, plan and elevation view progressions of the Triple Helix Horizontal Spanning Structure.

Referring to FIG. 6, shown from the left is section, plan and elevation view progression of the present invention 10. Shown is the present invention comprised of three helixes and cables forming its structural configuration. As the length of the super structure 12 increases the cables slowly revolve forming an inner cavity for placement of planar sub structure therein.

Figure 7:
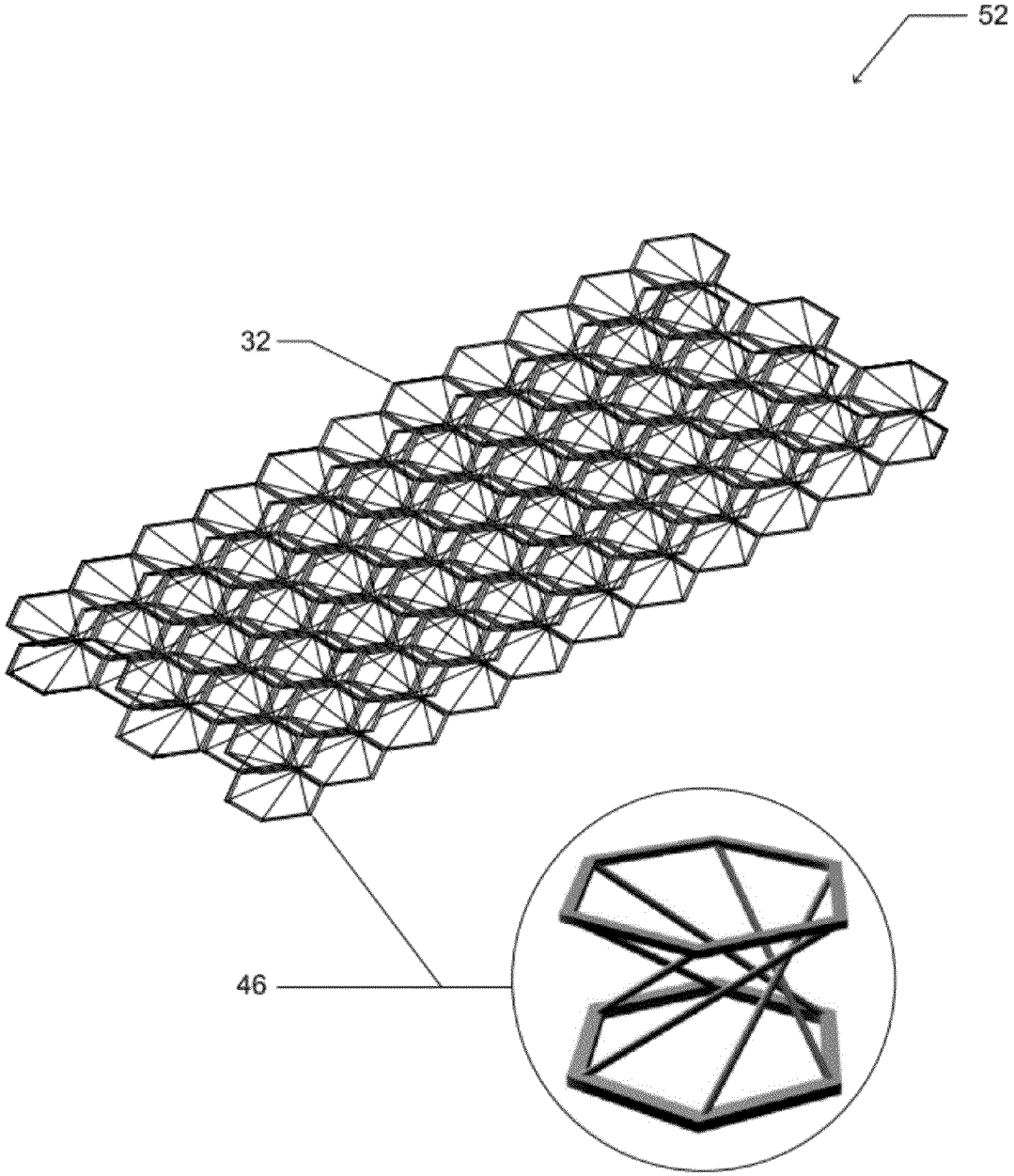
FIG. 7 is an illustrative view of sub structure, Hexagonal Space Frame, a planar deck of the present invention.

Referring to FIG. 7, shown is an illustrative view of the sub structure 32, a planar deck, Hexagonal Space Frame 52, of the present invention 10. Shown is one possible construction of the interior sub structure 32 of the triple helix super structure. The deck is composed of a pattern of Hexagonal Space Frame module 46 that connect and gang to form a planar structural surface.

Figures 8A, 8B, 8C:
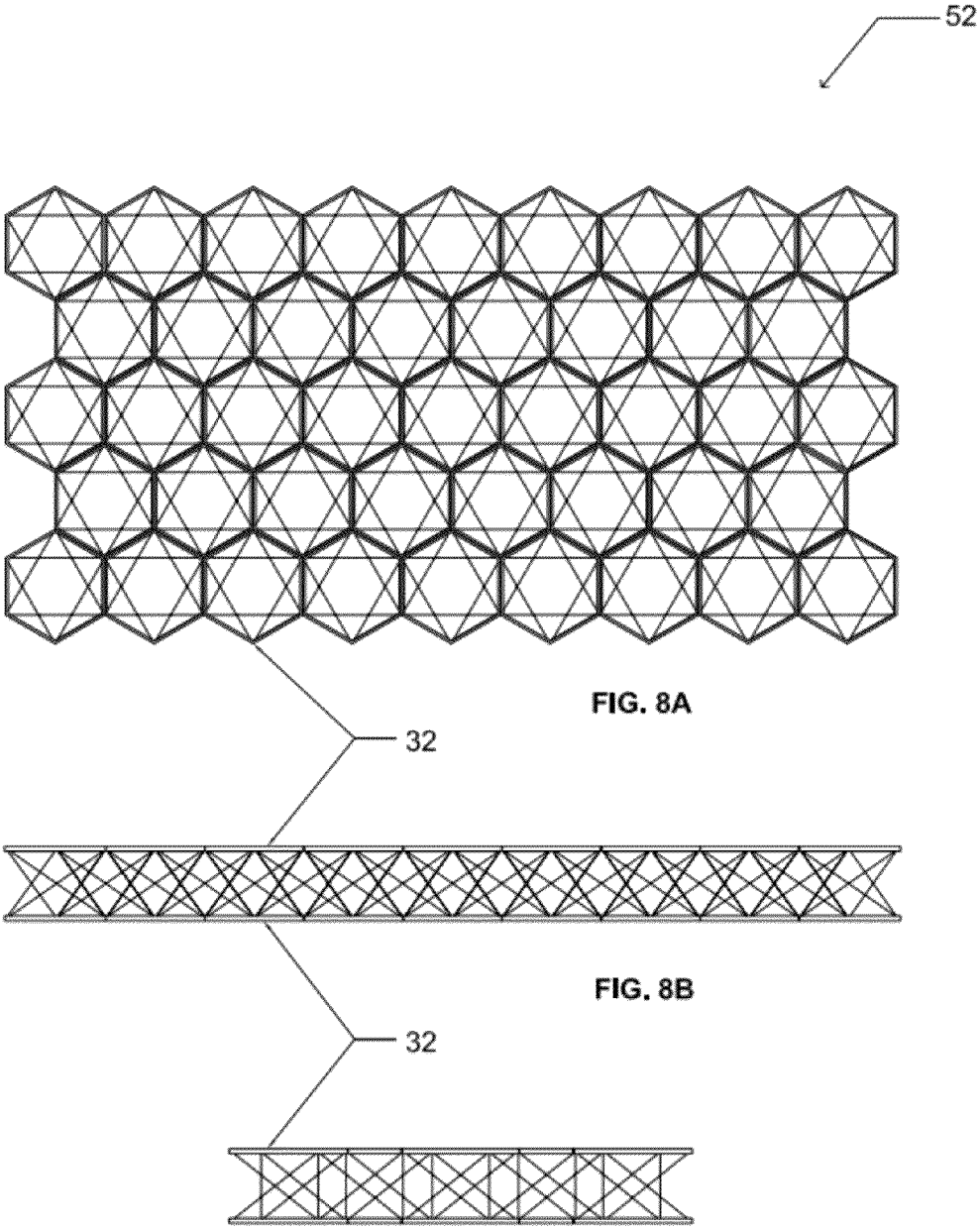
FIG. 8A is a plan view of the Hexagonal Space Frame of the present invention.
FIG. 8B is a side elevation view of the Hexagonal Space Frame of the present invention.
FIG. 8C is a front elevation view of the Hexagonal Space Frame of the present invention.

Referring to FIGS. 8A-8C, shown are plan, side elevation and front elevation views of sub structure 32, Hexagonal Space Frame 52, a planar deck of the present invention 10. Shown is one possible construction of the interior sub structure 32 of the triple helix super structure 12. The deck is composed of a pattern of Hexagonal Space Frame module 46 that connect and gang to form a planar structural surface.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A triple-helix horizontal spanning structure comprising:

a) an outer structure comprising three helical beams with a plurality of cables interconnecting said three helical beams;

b) a longitudinal space extending through said outer structure, said longitudinal space defined by said plurality of cables;

c) an inner structure disposed within said longitudinal space supported by said plurality of cables, said inner structure serving as a platform; and d) said inner structure formed from a plurality of hexagonal space frame modules interconnected laterally to form said platform, each hexagonal space frame module having upper and lower hexagonal frames interconnected by a plurality of web members.

2. The triple-helix horizontal spanning structure according to claim 1, wherein the area of said longitudinal space within said outer structure is 25% of the area defined by the perimeter of the three helical beams.

3. The triple-helix horizontal spanning structure according to claim 1, wherein said outer structure includes anchors disposed at opposed ends thereof.

4. The triple-helix horizontal spanning structure according to claim 1, wherein said upper hexagon is vertically spaced and superposed over said lower hexagon, each of said upper and lower hexagons having six points numbered one through six, each of said six points of said lower hexagon being vertically aligned with its respective point on said upper hexagon, each said web being attached to a respective point on said upper hexagon at a point with a number that is two more than the number of the point the same web is attached to on the lower hexagon.

* * * * *